United States Patent [19]

Fredricks et al.

[11] 3,997,024

[45] Dec. 14, 1976

[54] PORTABLE SCAFFOLD LADDER

[76] Inventors: Anthony T. Fredricks, 1932 Sunrise Rim, Boise, Idaho 83705; Paul F. Smith, 4621 Mountain View Drive, Boise, Idaho 83704

[22] Filed: Nov. 19, 1975

[21] Appl. No.: 633,363

[52] U.S. Cl. ..... 182/17; 182/119; 182/15

[51] Int. Cl.[2] ..... E04G 1/18

[58] Field of Search ..... 182/119, 118, 152, 15, 182/17, 178, 179, 115; 211/176, 178 R

[56] References Cited

UNITED STATES PATENTS

| | | | |
|---|---|---|---|
| 3,020,972 | 2/1962 | Hockett | 182/15 |
| 3,190,406 | 6/1965 | Usher | 182/152 |
| 3,212,605 | 10/1965 | Dickerson | 182/159 |
| 3,556,248 | 1/1971 | Brown | 182/15 |
| 3,566,990 | 3/1971 | Fredricks | 182/119 |

*Primary Examiner*—Reinaldo P. Machado
*Attorney, Agent, or Firm*—Klarquist, Sparkman, Campbell, Leigh, Hall & Whinston

[57] ABSTRACT

A portable collapsible scaffold ladder has a pair of upright caster-mounted end members joined together by a horizontal platform member. A pull-out ladder for ascending to the platform is connectable at its upper end and slidable along its connected end member for movement between a nested position within that end member and a diagonally extending operative position. The platform member is joined to the two end members by T-shaped glide members pivoted to each of the four corners of the platform member. Each glide member has a glide portion slidable along one side of a connected end member and a pivot portion pivoted to an adjacent side portion of the platform member. Each glide member has a resilient leaf-type spring which carries two locking pins, one for interlocking with the platform and the other for interlocking with one of a series of pin-receiving openings in the upright. When the pins are engaged, the glide members rigidly interlock the platform member and two end members at right angles for use, or in parallel collapsed relationship for transport. When one pin of each pair of glide members is disengaged, the platform can be moved along the adjacent end member. When the opposite pin of each pair of glide members is disengaged, the platform and end members can be freely pivoted with respect to one another.

12 Claims, 7 Drawing Figures

PORTABLE SCAFFOLD LADDER

BACKGROUND OF THE INVENTION

1. Field of the Invention

The present invention relates to scaffolds and more particularly to a combination scaffold-ladder which is selectively mobile when erected and selectively collapsible into a compact unit for portability.

2. Description of the Prior Art

The scaffold-ladder of the present invention is an improvement of the scaffold-ladder disclosed in applicants' prior U.S. Pat. No. 3,566,990, issued Mar. 2, 1971. Such prior scaffold-ladder was designed for mobility when erected and for portability when collapsed as is the scaffold-ladder of the present invention. However, the prior such scaffold-ladder incorporated a ladder as part of each of the opposite upright end members, making the unit heavier than necessary.

Also, a complex multi-part glide and connector assembly interconnected the platform member and the upright ladder end members and provided adjustment of the platform member along such end members. Such glide and connector assembly was inconvenient and time consuming to use for adjusting the platform height and for collapsing the scaffold assembly for transport.

In addition, the glide and connector assembly did not provide a satisfactorily rigid joint, requiring the use of diagonal bracing for this purpose.

SUMMARY OF THE INVENTION

According to the present invention, an improved mobile and collapsible portable scaffold-ladder is provided which is lighter in weight, and yet is sturdier in construction than the scaffold-ladder of applicants' aforementioned prior patent. This feature is achieved through the use of a single, pull-out type ladder optionally connectable to and nestable within either upright end member and through the use of an open frame construction throughout using rectangular tubing.

The scaffold-ladder of the invention also has an improved glide-joint between the upright end member and platform which provides a simpler, quicker platform adjustment, a more rigid joint, easier collapsibility of the scaffold assembly and a more compact unit when collapsed than prior scaffold-ladders. A single T- or L-shaped glide member forms the joint with one leg of the member being slidable along one side of an adjacent end member and the other leg being pivoted to a side of the platform member. Locking pins at the opposite ends of a leaf-type spring attached to each glide member interlock the end and platform members and are selectively releasable to enable adjustment of the height of the platform or collapse of the assembly for transport.

A primary object of the invention is to provide a portable scaffold-ladder having more rigid joints between the platform member and the upright end members when the scaffold is erected for use than prior such structures.

A second primary object of the invention is to provide a significant reduction in the weight of the scaffold assembly.

A third primary object is to provide quick and easy adjustability of the platform along the upright end members.

A fourth primary object is to provide fast, easy collapsibility of the scaffold assembly for transport when desired or for use as a stepladder.

A fifth primary object is to provide an improved and simplified combination glide and connector member for interconnecting the platform and end members and for adjusting the platform along the end members.

Another object is to provide a scaffold-ladder which is of simplified and economical construction and which is capable of being used as a convenient package transport of variable heights for stacking and transporting shelf-stored commodities.

The foregoing and other objects, features and advantages of the present invention will become more apparent from the following detailed description which proceeds with reference to the accompanying drawings.

DETAILED DESCRIPTION

Figure 1:
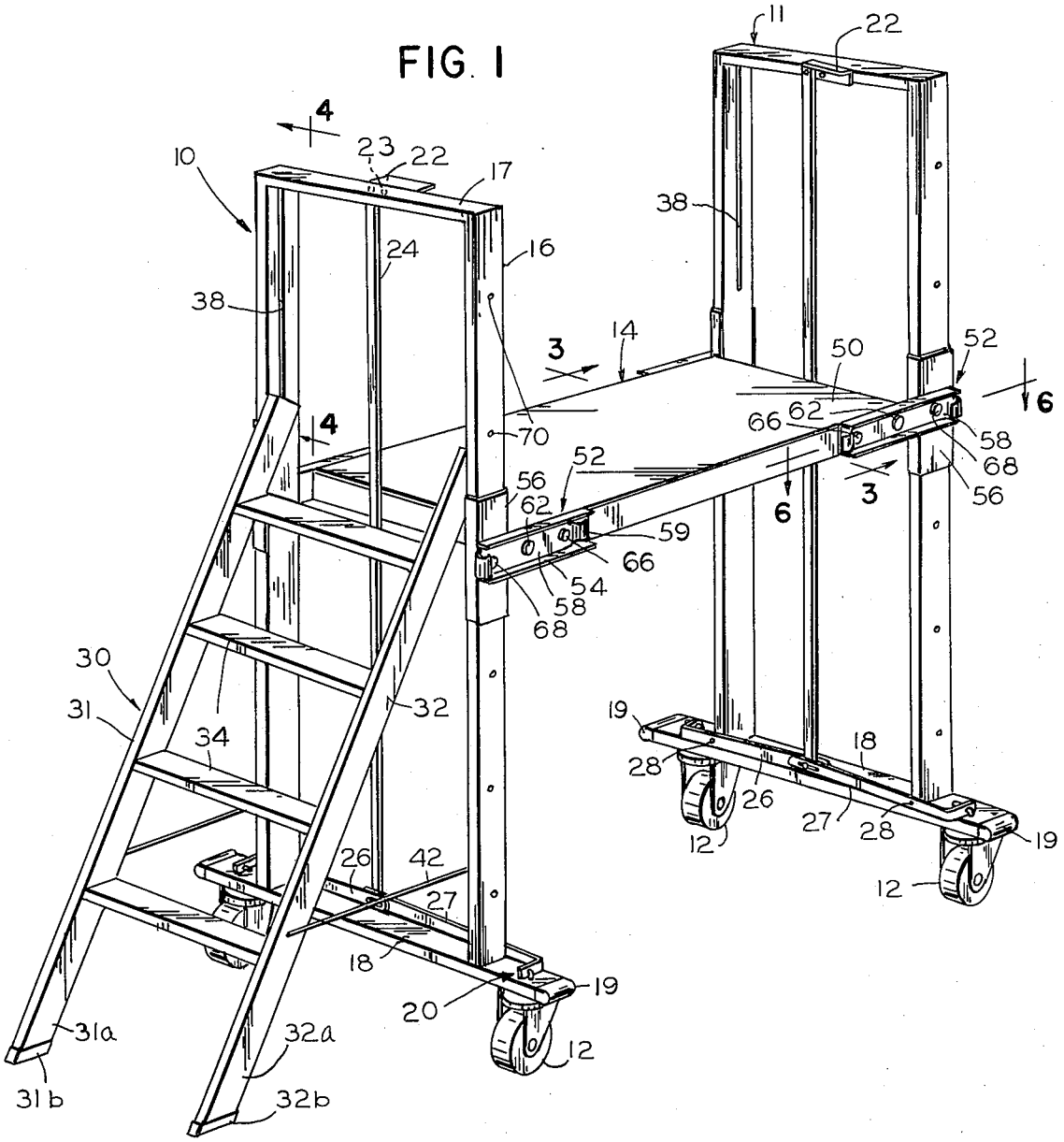
FIG. 1 is a perspective view of a scaffold-ladder in accordance with the invention shown in its operative position.

Referring first to FIG. 1 of the drawings, the portable collapsible scaffold ladder of the invention includes a pair of upright end members 10, 11 mounted on casters 12 and joined by a platform member 14 which extends horizontally between the end members when the scaffold-ladder is erected for use as shown.

Figures 2, 3, 4, 5, 7:
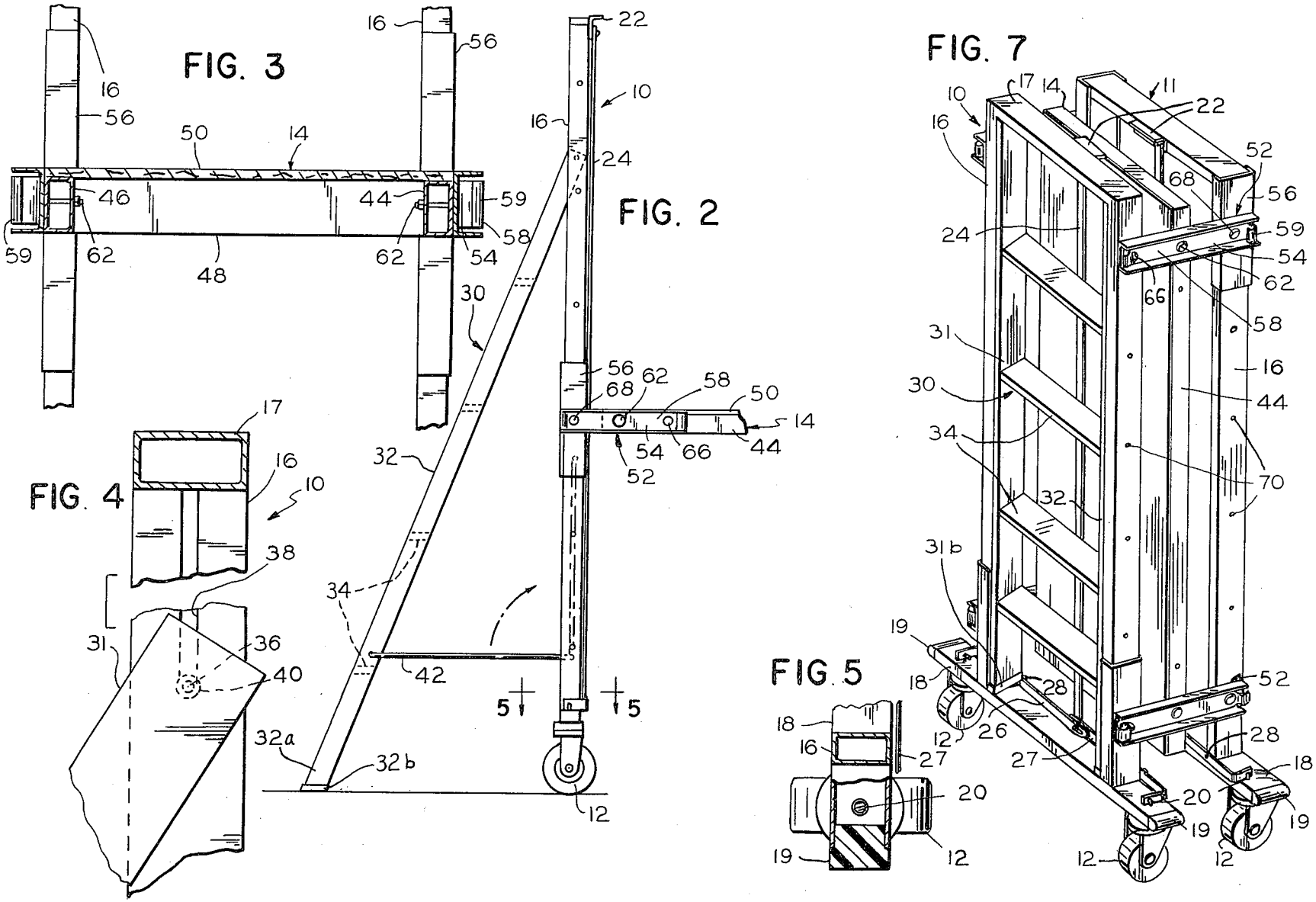
FIG. 2 is a partial side view of one end of the scaffold-ladder of FIG. 1.
FIG. 3 is an enlarged cross-sectional view taken along the line 3—3 of FIG. 1.
FIG. 4 is a vertical sectional view taken approximately along the line 4—4 of FIG. 1.
FIG. 5 is a horizontal sectional view on an enlarged scale taken along the line 5—5 of FIG. 2.
FIG. 7 is a perspective view showing the scaffold-ladder in its collapsed condition.

Each end member 10, 11 is of open rectangular frame construction and includes a pair of opposite vertical side frame members 16 joined at their upper ends by a cross frame member 17 and at their lower ends by a base member 18. Each base member 18 extends outwardly beyond side frame members 16 of the upright end members and mounts the casters 12 inwardly of its outer ends. As shown in FIG. 5, the opposite ends of each base member 18 are provided with elastomer bumpers 19 having reduced portions inserted within such tubular ends. The bumpers 19 protect walls and other objects from damage when contacted by the scaffold-ladder.

Casters 12 are of a construction similar to those shown in the aforementioned U.S. Pat. No. 3,566,990. Braking means 20 selectively lock the caster wheels against rolling movement. Such braking means are similar to the braking means shown in the aforementioned patent and include a brake for each caster wheel.

The brakes are applied by a brake-actuating mechanism carried by each upright end member. The brake-actuating mechanism includes an actuating lever 22 pivoted at 23 between its end to the side surface of the top cross frame member 17. A brake-actuating rod or bar 24 is pivoted at its upper end to an end portion of actuating lever 22 and extends downwardly beyond the base of the end member and is connected at an intermediate point to a pair of pivotally interconnected brake-actuating arms 26, 27. The outer end of each arm 26, 27 carries a brake 20 for one of the caster wheels. Each brake 20 may be in the form of a simple brake pin as shown, extending downwardly through base member 18 and the caster for engagement with the periphery of a caster wheel 12 or may include a brake shoe for this purpose. Each brake-actuating arm 26, 27 is pivoted at 28 to an upright end member 10, 11 near its base 18. Thus when actuating lever 22 is pivoted upwardly from its horizontal brake-setting position shown by someone standing on platform 14, rod 24 is lowered, dropping the interconnected inner ends of brake arms 26, 27 about their pivotal connections 28, thereby raising the outer ends of the arms and lifting brake pins 20 to release them from braking engagement with caster wheels 12. Other suitable braking arrangements could also be used such as the one shown in the aforementioned U.S. Pat. No. 3,566,990.

The side, top and base frame members defining each upright end member are preferably formed of rectangular tubing for strength, rigidity and light weight, giving the frame members a box cross section. It has been found that rectangular tubing of 1 inch by 2 inch dimension made of mild steel is of sufficient strength for all frame members of the scaffold-ladder, including the upright end members, the platform member, and the ladder member, all of which will be described.

In the interest of saving weight, the scaffold-ladder is provided with a single pull-out type ladder member 30 made of the described rectangular tubing and including a pair of spaced-apart side members 31, 32, the lower ends of which define floor-engaging legs 31*a*, 32*a*. The ladder side members are joined by step cross members 34.

The lower ends of ladder legs 31*a*, 32*a* are cut diagonally so that when ladder 30 is pulled out from its connected end member, the lower ends of the ladder legs lie flat on the floor. Also, such lower ends are preferably provided with rubber feet 31*b*, 32*b*, for nonskidding contact with the scaffold support surface.

As shown in FIGS. 1 and 4, the upper ends of the two ladder side members 31, 32 extend inside the two side frame members 16 of the connected upright end member 10. The connection includes a pin or bolt 36 extending through an upper end of each ladder side member and through a longitudinal slot 38 in the inwardly facing side of each side frame member 16 of upright end member 10. Bolt 36 is slidably retained within slot 38 by a washer 40 and nut (not shown) threaded onto the bolt. The described connection enables sliding movement of the upper end of the ladder along the upper portion of the connected end member so that the lower end of the ladder can be pulled out from the end member or nested within the end member as desired.

As shown in FIGS. 1 and 2, brace members 42 are pivoted at one end of each to lower portions of ladder side members 31, 32 and at their opposite ends to lower portions of the side frame members of upright end member 10 to limit the diagonal extent to which the lower end of the ladder can be pulled away from the connected end member. FIG. 2 shows that the ladder forms an angle of about b 30° with the upright end member when pulled out to the maximum to provide access to platform member 14. When not in use ladder 30 is nested within its connected end member simply by pushing or pulling the upper end of the ladder vertically along the slot or trackway in the opposite side frames of the end member. This causes braces 42 to pivot upwardly and inwardly to bring the ladder side members inwardly alongside the side members of upright 10, as shown in FIG. 2. As shown in FIG. 7, the ladder uprights 31, 32 are slightly shorter than the inside dimension of the end members 10, 11; and, with their rubber feet, fit snugly within the end members in a nested position when desired. When the unit is used either as a commodity transport or as a scaffold, the ladder is pulled into its nested position to facilitate mobility along a wall without the user having to descend from his position on the platform.

The details of construction of platform member 14 are shown in FIG. 3. The platform is constructed of a pair of longitudinal side frame members 44, 46 joined by opposite end frame members 48, only one of which is shown, all preferably formed of 1 inch by 2 inch rectangular tubing, to define an open rectangular frame similar to the open rectangular box frame construction of end members 10, 11. The platform frame is covered on top by a plank or suitable sheet of plywood to form a platform surface 50.

The connector means for joining the platform to the end members include four glide members 52 at the four corners of platform member 14. each glide member 52 is generally T-shaped as shown in FIGS. 1 and 2. However, such members could also be L-shaped, although the L-shape might not provide as great rigidity as the T-shape. One leg 54 of each glide member comprises a pivot portion and is pivoted to a side of the platform member 14 at 62. The other leg or cross arm 56 of each glide member comprises a glide portion and is in sliding engagement with a side member 16 of one of the upright end members 10, 11. Glide portion 56 and pivot portion 54 of each glide member are rigidly interconnected, as by welding, at right angles to one another. Each is of channel cross section, as will be apparent from FIGS. 3 and 6. The flanges of the channel of glide portion 56 extend about the side frame member 16 of the associated end member for sliding engagement therewith. The flanges of the channel of pivot portion 54, however, extend outwardly away from adjacent platform member 14.

A flat leaf-type resilient spring 58 extends along the bottom of the channel of pivot portion 54. The spring has opposite ends curving away from the bottom of the channel to define handles 59, 60, as shown best in FIG. 6, for lifting the opposite ends of the spring away from the channel bottom for a purpose to be explained. A threaded pivot bolt 62 with an enlarged wing-type head 62*a* within the channel of pivot portion 54 extends through a center portion of leaf spring 58, through pivot portion 54 and through the adjacent longitudinal side frame member of platform 14. The pivot bolt is threaded through a nut 64 affixed to the inside face of platform side member 44 to secure the spring, glide member and platform member together and to enable relative pivoting movement between the glide member and the platform member.

Figure 6:
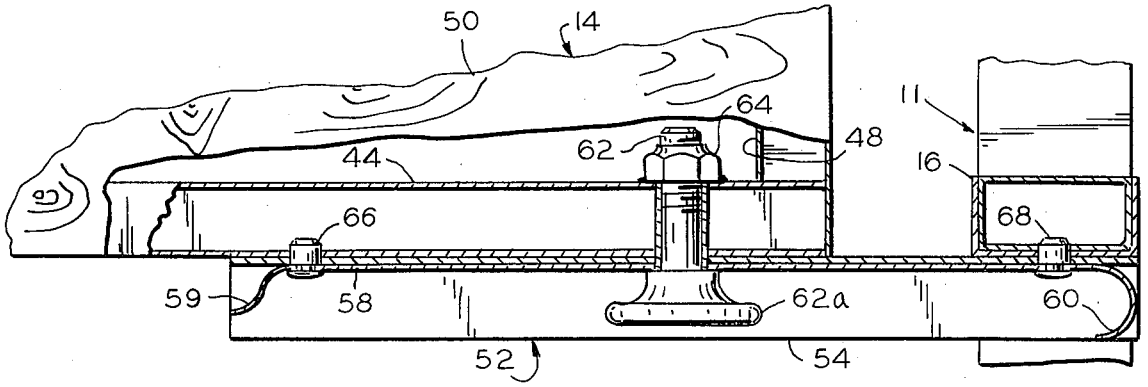
FIG. 6 is a horizontal sectional view taken along the line 6—6 of FIG. 1.

The leaf spring of each glide member 52 carries means for interlocking the platform member 14 and opposite end members 10, 11 in their erected and collapsed positions and in various selected height positions of the platform member. Such interlock means includes a first locking pin 66 carried by one end of the leaf spring 58. Pin 66 is urged by the spring through aligned openings in pivot portion 54 of the glide member and the side frame member 44 of platform 14, as shown in FIG. 6, to prevent relative pivoting movement between the glide member and platform. The interlock means also includes a second locking pin 68 carried by the opposite end of leaf spring 58. Pin 68 is urged by its spring through aligned openings in pivot portion 54 and glide portion 56 of glide member 52 and into one of several pin-receiving openings 70 spaced along the sides of end members 10, 11 to retain the platform at a selected height along the end members. Thus spring 58 serves as a resilient retainer means for retaining the locking pins on the glide member and urging them into their locking positions.

Leaf spring 58 normally biases locking pins 66, 68 into locking engagement with their respective platform and end members 14, 10 and 11. However, by pulling outwardly on handle 59 of the leaf spring, locking pin 66 is retracted from platform member 14 thereby enabling relative pivoting movement in a vertical plane between the platform member and the adjacent upright end member 10 or 11. Similarly, by pulling outwardly on the handle 60 at the opposite end of leaf spring 58, the locking pin 68 is retracted from an opening 70 in the end member 10 or 11, thereby enabling sliding movement of the glide member 52 along the end member for adjusting the height of platform 14.

The scaffold-ladder assembly is shown in FIGS. 1 and 2 erected for use and in FIG. 7 collapsed and ready for transport.

To collapse the scaffold assembly from its erected position, ladder 30 is first pushed inwardly and upwardly to its nested position within end member 10.

Then locking pins 66 of the glide members adjacent to end member 10 are retracted from the sides of platform member 14 so that the glide can rotate against the side of the platform 14. Locking pins 68 are then retracted from end member 10 and the glides lowered to the bottommost pin-receiving opening 70 of end member 10.

Then the same procedure is followed with respect to the glide members for end member 11 except that the glides are raised to the topmost position 70 of end member 11, thus pivoting end member 11 and platform 14 into a position parallel to and very near end member 10.

With the two end members and platform member 14 all parallel to one another and in upright positions on casters 12, the locking pins 66 in the lowermost glide members 52, now at the base of end member 10, are inserted into the lowest of the pin-receiving openings 70 near the base of end member 11; and locking pins 66 in the uppermost glide members 52, now at the top of end member 11, are inserted into the highest pin-receiving openings 70 near the top of end member 10, thereby interlocking the two uprights and platform member 14 together at both upper and lower ends, thus firmly connecting the assembly together in a compact, collapsed or telescoped, but upright, portable position.

With the scaffold assembly in its collapsed position and the brakes applied to the caster wheels 12, the ladder 30 can be pulled out from upright 10 and the unit used as a step or trestle ladder if desired.

Having illustrated and described what is presently a preferred embodiment of the invention, it should be apparent to those skilled in the art that the same is capable of modification in arrangement and detail without departing from the principles of the invention as disclosed. We claim as our invention all such modifications as come within the true spirit and scope of the following claims.

We claim:

1. A portable collapsible scaffold comprising:

a pair of horizontally opposed and spaced-apart wheel-mounted upright end members, a platform member extending when operative horizontally between said upright end members, connector means for joining the opposite ends of said platform member to said upright end members and for adjusting the height of said platform member along said end members, said connector means comprising a glide member having a pivot portion extending along one side of said platform member and pivoted thereto to enable relative pivoting movement between said glide member and said platform member in a plane of said end members and a glide portion extending at right angles to said pivot portion along a corresponding side of an adjacent side end member and adapted for sliding movement therealong, said glide and pivot portions being rigidly interconnected, and interlock means carried by said glide member for interlocking said end members and said platform member at right angles to one another at selected positions along said end members.

2. Apparatus according to claim 1 wherein said interlock means comprises a first retractable locking pin means extendable through said pivot portion and into said platform member at a position preventing relative pivoting movement between said pivot portion and said platform member, a second retractable locking pin means extendable through said glide portion and into one of multiple pin-receiving openings in said adjacent end member, and resilient retaining means for retaining said first and second locking pin means on said glide member and biasing them into interlocking engagement with said upright end member and said platform member.

3. Apparatus according to claim 1 wherein said glide member is right-angular in shape and includes a first leg comprising said pivot portion and a second leg at right angles to said first leg comprising said glide portion, a leaf-type spring means extending along said first leg and connected thereto between its opposite ends, said interlock means comprising a first locking pin carried by one end portion of said spring means and urged by said spring means toward locking engagement with said platform member, and a second locking pin at the opposite end of said spring means and urged by said spring means toward locking engagement with an adjacent said end member, said spring means including means for selectively withdrawing said first locking pin away from said platform member to enable relative pivoting movement between said platform member and said adjacent end member and for selectively withdrawing said second locking pin from said adjacent end frame member to enable sliding movement of said glide member and thus said platform member along said end member for adjusting the height of said platform member.

4. Apparatus according to claim 1 wherein each said end member is of open rectangular frame construction with each said frame including a pair of laterally opposed vertical side frame members of box cross section, said connector means including four said glide members, one at each of the four corners of said platform member, said glide portion of each glide member being of channel section and being sized to extend about and slide along an outer sidewall and opposite end wall of an associated said side frame member, the outer sidewall of each said side frame member including a series of pin-receiving openings extending therethrough at spaced positions along its length, said interlock means including a locking pin carried by said glide member and urged toward said outer sidewall for selected insertion into one of said pin-receiving openings for positioning said platform member at a selected height along said upright end member.

5. Apparatus according to claim 4 wherein said pivot portion of each said glide member is of channel section rigidly connected to said channel shaped glide portion back to back, said platform member comprising a pair of opposite longitudinal side frame members, a flat resilient leaf-type spring extending within the channel of said pivot portion, a pivot pin means extending through a center portion of said leaf-type spring and through said pivot portion and through said longitudinal side frame member of said platform member to pivotally interconnect said spring, glide member and platform member, said interlock means including first and second locking pins carried by opposite end portions of said spring and urged by said spring through apertures in said glide member toward said pin-receiving openings in said vertical side frame member and toward a pin-receiving opening in said longitudinal side frame member of said platform member for interlocking said end member and platform member.

6. Apparatus according to claim 1 including a ladder member connected at an upper end portion thereof to an upper portion of one said upright end member for sliding movement along said upper portion of said one end member, said ladder member being movable between a nested position extending parallel and closely adjacent to said one end member to an operative position extending diagonally downwardly and outwardly from said one end member through sliding movement of said ladder upper end portion along said end member.

7. Apparatus according to claim 6 wherein said ladder member includes pivotable brace means interconnecting said ladder member and said end member below said siding connection between said members to limit diagonal outward movement of said ladder member away from said one end member.

8. Apparatus according to claim 6 including means for selectively retaining said ladder member in its said nested position.

9. Apparatus according to claim 1 wherein said opposite end members each comprise an open rectangular frame composed of opposite side frame members joined by top and base cross frame members, said platform member including an open rectangular support frame composed of opposite longitudinal side frame members joined by opposite end frame members, all of said frame members of said end members and said platform member comprising rectangular tubing.

10. A portable collapsible scaffold comprising a pair of wheeled upright end members each of open rectangular frame construction including opposite side frame members, said upright end members being joined together by a horizontally extending platform member, a ladder member with opposite side members and interconnecting steps optionally connectable to either one of said opposite end members, the lateral spacing between said ladder side members being less than the spacing between said upright side frame members so that said ladder member can be nested within said upright end members, connecting means for slidably connecting upper ends of said ladder side members to upper inside portions of the opposite side frame members of one said end member for sliding movement of the upper end of said ladder member along the upper portion of said one end member, a lower end portion of said ladder member being freely movable away from the connected said end member such that said ladder is movable between a first position nested within said connected end member and an operative second position wherein said ladder member extends diagonally outwardly and downwardly from its connection with said one end member to engage a supporting floor surface for said scaffold to provide access to said platform member.

11. Apparatus according to claim 10 including means for selectively retaining said ladder member in its first said nested position and means for limiting outward movement of said ladder member away from said connected end member.

12. Apparatus according to claim 10 including connector means for joining said platform member to said opposite end members, said connector means including glide members operable selectively to (1) interlock said end members and said platform member at right angles, (2) enable sliding adjustment of said platform member along said end members, (3) enable relative pivoting movement between said end members and said platform member to collapse said end members and platform member into closely adjacent parallel relationship, and (4) interlock said end members and platform member in said collapsed parallel relationship.

* * * * *